US008620534B2

(12) United States Patent
Jessen et al.

(10) Patent No.: US 8,620,534 B2
(45) Date of Patent: Dec. 31, 2013

(54) MOBILE WORKING MACHINE WITH A CONTROL DEVICE, COMPRISING A WORKING ARM AND METHODS FOR CONTROLLING THE OPERATING POINT OF A WORKING ARM OF A MOBILE WORKING MACHINE

(75) Inventors: Soenke Jessen, Tamm (DE); Steffen Klein, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 13/391,083

(22) PCT Filed: Aug. 4, 2010

(86) PCT No.: PCT/EP2010/004784
§ 371 (c)(1),
(2), (4) Date: Apr. 26, 2012

(87) PCT Pub. No.: WO2011/020561
PCT Pub. Date: Feb. 24, 2011

(65) Prior Publication Data

US 2012/0201640 A1 Aug. 9, 2012

(30) Foreign Application Priority Data

Aug. 18, 2009 (DE) ..... 10 2009 037 880

(51) Int. Cl.
*G06F 7/70* (2006.01)

(52) U.S. Cl.
USPC ..... 701/50; 414/694

(58) Field of Classification Search
USPC ..... 701/50; 414/694, 697, 699
See application file for complete search history.

(56) References Cited

U.S. PATENT DOCUMENTS 5,559,725 A * 9/1996 Nielson et al. ..... 700/302
5,854,988 A * 12/1998 Davidson et al. ..... 701/50

(Continued)

FOREIGN PATENT DOCUMENTS

DE 39 07 134 A1 9/1990
DE 201 16 666 U1 3/2003

(Continued)

OTHER PUBLICATIONS

International Search Report corresponding to PCT Application No. PCT/EP2010/004784, mailed Nov. 22, 2010 (German and English language document) (7 pages).

*Primary Examiner* — Thomas Black
*Assistant Examiner* — Shardul Patel
(74) *Attorney, Agent, or Firm* — Maginot, Moore & Beck

(57) ABSTRACT

The disclosure relates to a mobile working machine with a control device, comprising a working arm, and methods for controlling the operating point of a working arm of a mobile working machine. According to the disclosure, the mobile working machine with the control device, comprising a working arm, has a working arm, a first end of which is hinged to a superstructure of the working machine. A tool is movably arranged on a second end of the working arm at an operating point. At least one first inclination sensor lies on the superstructure and at least one second inclination sensor lies on the working arm. In addition, at least one hydraulic cylinder is provided for changing the position of the operating point, said cylinder being hinged between the superstructure and the working arm. Furthermore, a control unit for processing signals from the at least two inclination sensors is provided to determine an operating point as a reference operating point and to ascertain a position change of the operating point by calculating a cylinder stroke on the basis of a volume flow into or out of the hydraulic cylinder.

13 Claims, 5 Drawing Sheets

(56) References Cited

U.S. PATENT DOCUMENTS

| | | | | |
|---|---|---|---|---|
| 6,209,232 | B1 * | 4/2001 | Ono et al. | 37/348 |
| 6,357,132 | B1 * | 3/2002 | Banks | 33/700 |
| 6,377,906 | B1 * | 4/2002 | Rowe | 702/151 |
| 6,546,325 | B1 * | 4/2003 | Kubota et al. | 701/50 |
| 8,137,047 | B2 * | 3/2012 | Ishii et al. | 414/699 |
| 8,145,394 | B2 * | 3/2012 | Chiorean et al. | 701/50 |
| 2009/0055058 | A1 * | 2/2009 | Morris et al. | 701/50 |

FOREIGN PATENT DOCUMENTS

| | | |
|---|---|---|
| EP | 1 983 305 A1 | 10/2008 |
| WO | 99/35462 | 7/1999 |
| WO | 01/57474 | 8/2001 |

* cited by examiner

MOBILE WORKING MACHINE WITH A CONTROL DEVICE, COMPRISING A WORKING ARM AND METHODS FOR CONTROLLING THE OPERATING POINT OF A WORKING ARM OF A MOBILE WORKING MACHINE

This application is a 35 U.S.C. §371 National Stage Application of PCT/EP2010/004784, filed on Aug. 4, 2010, which claims the benefit of priority to Serial No. DE 10 2009 037 880.4, filed on Aug. 18, 2009 in Germany, the disclosures of which are incorporated herein by reference in their entirety.

BACKGROUND

The disclosure relates to a mobile working machine, for example an excavator, a truck with an attachment or an agricultural or forestry implement, having at least one working arm. Working arms of such working machines can also have a plurality of segments which are connected to one another in an articulated fashion, wherein a first end of the working arm is arranged in an articulated fashion on a superstructure of the working machine, and a second end of the working arm has a tool such as a shovel, a gripper or a hammer.

Often, the current position and attitude of the working arm, and in particular of the tool as well, are displayed to the operator of such a working machine as an operating point on a display, allowing the operator to work according to precisely predefined plans and providing direct feedback about attained heights, lengths, depths or angles of inclination of, for example, a moved about bulk material or soil or of the underlying surface which is to be formed or is already formed, in relation to the operating point of the working arm.

Such operator control displays are known, for example, from DE 201 16 666 U1 and from U.S. Pat. No. 5,854,988 A.

In this context, the operating point and the attitude of the tool are also determined by inclination sensors because of the possibility of easy retrofitting, wherein at least a first inclination sensor is arranged on the superstructure and a second inclination sensor is arranged on the working arm. The position and attitude of the tool and/or the operating point can be calculated from the angles of inclination of the working arm and superstructure.

However, since the inclination sensors used are sensors which are based on the principle of measuring inertia such as, for example, gravitation-sensitive pendulums, they are also sensitive to accelerations owing to shocks and vibrations such as unavoidably occur when such working machines are in use. In particular, measurement errors occur when the attached tool is accelerated and braked. Such movement-induced accelerations can considerably disrupt the measurement of the operating point of the tool or make it impossible at certain times.

Nevertheless, when the tool is in a stationary state, precise reference values for calculating the actual value of an operating point at the start and at the end of a change in the operating point can be determined by the inclination sensors accompanied by evaluation in a central control unit. However, inclination sensors are unsuitable for controlling the operating point in order to track and control changes in the position or in the operating point of the tool since they provide precise measurement values of the inclinations only when the working machine is in a stationary state.

From other technical fields it is known to use acceleration-based inclination sensors and rotational speed sensors in order to control the position of a robot, of a missile or of a vehicle. Document WO 01/57474 A1 discloses such a method in which a quaternion representation is used to calculate an operating point. Such systems are highly complex and associated with high costs.

The object of the disclosure is to specify a mobile working machine with a device for detecting the position and controlling the operating point for implements, which device permits an operating point to be automatically moved with a small number of easy-to-integrate components. A further object of the disclosure is to specify a method for such an operating point control system.

According to the disclosure, this object is achieved. Advantageous developments of the disclosure are described herein.

A mobile working machine according to the disclosure has a working arm which is arranged in an articulated fashion with a first end on a superstructure of the working machine. A tool is arranged at a second end of the working arm so as to be capable of moving to an operating point. At least one first inclination sensor is arranged on the superstructure, and at least one second inclination sensor is arranged on the working arm. Furthermore, at least one hydraulic cylinder is provided which is arranged in an articulated fashion between the superstructure and the working arm in order to change the position of the operating point. Furthermore, a control unit is provided for processing signals of the at least two inclination sensors for determining an operating point as a reference operating point and for determining a change in position of the operating point by calculating a cylinder travel on the basis of a volume flow into or out of the hydraulic cylinder.

This mobile working machine has the advantage that it can be implemented with simple control and measuring components by monitoring the actual position before a change in position as a reference position and during the change in position by means of a cylinder travel distance, wherein the change in the cylinder travel permits a new actual position which can be checked by a precise position when the working arm is in a stationary state, and the difference with respect to a setpoint value can be compensated by feeding back the precisely measured actual position into the control unit via a feedback branch the difference between the actual position and the setpoint position.

As a result, all that is necessary is to provide at least two inclination sensors for the control device. The necessary cylinder travel for a change in position can, on the other hand, be determined by the known volume flow and the known cylinder dimensions by measuring the time or predefining the time. As a result, an economical solution for the monitoring and control of the changes in position of the working arm of a working machine is achieved. The implementation of the detection of a position for the implements of a mobile working machine with a small number of simple components which can be integrated is therefore possible and as a result of the possibility, now provided, of automatically moving to operating positions, the performance factor of the mobile working machine is advantageously improved.

In a further embodiment of the disclosure, the working arm has a number of segments which are connected to one another in an articulated fashion. In this context, each of these segments is equipped with an additional hydraulic cylinder in order to move said segment with respect to the other segments of the working arm. Each of the segments of the working arm then requires an additional inclination sensor to determine the reference point, and for the change in position of such a segment it is in turn possible to use the cylinder travel which can be calculated by means of the volume flow in the corresponding additional hydraulic cylinders.

If the superstructure is rigidly connected to a chassis, as in the case in a tractor, the operating point of the tool relative to the tractor can be determined with the components according to the disclosure. However, in the case of excavators, the superstructure is mounted so as to be horizontally rotatable with respect to the chassis, with the result that in a further embodiment of the disclosure a means of sensing the rotational angle in order to determine the operating point is additionally provided. This sensing of the rotational angle of the superstructure with respect to the chassis now advantageously permits the operating point, and the change in position thereof, to be spatially sensed in a three-dimensional coordinate system.

The inclination sensors, which can sense the reference working point of the mobile working machine precisely in a starting position of rest and also senses the actual position of a change in position by the hydraulic cylinder, preferably have pendulum bodies, refractive liquid levels, micromechanical or conductormetric or capacitively acting structures. In this context, excavators, tractors with front loaders, telescopic loaders, backhoe loaders, wheel loaders, forestry machines, communal working machines, agricultural machines and/or loading cranes are provided as mobile working machines.

A method for controlling the operating point of a working arm of a mobile working machine has the following method steps. Firstly, angles of inclination of the superstructure and of a working arm which is arranged in an articulated fashion with a first end on the superstructure are measured by means of inclination sensors. Then, a first reference position of the operating point at a second end, bearing a tool, of the working arm is calculated taking into account the measurement results of the measured angles of inclination. Finally, a change in position of the operating point into a predefined setpoint position is carried out by means of a hydraulic volume flow during a limited time interval. The change in position is subsequently checked by the inclination sensors by determining an actual position of the operating point. By comparing the actual position with the predefined setpoint position into which the working arm is to be pivoted, a difference is obtained in the form of a control deviation between the setpoint position and the actual position, which subsequently leads to a reduction in a difference between a setpoint position and the actual position by repeatedly running through the first four method steps.

This method has the advantage that a small number of iterative steps make it possible to ensure that the actual position virtually reaches the setpoint position without complex calculations or complex structures or complex measuring techniques being necessary to reach a predetermined, changed operating point precisely. In this context, the known volume flow, the effective piston area and the time period are taken into account for the calculation of the change in position of the operating point. From the travel which is to be executed for a change in position, the oil flow and the activation duration can be calculated and the working machine is correspondingly controlled in order, for example, to permit operating points to be moved to automatically. First results show that with the method according to the disclosure it is possible to achieve a high degree of positional accuracy of the changed operating point. The deviations between the actual position and the setpoint position can finally be reduced by iterative steps.

Furthermore, it is possible to sense safety positions for the operating points and to store critical operating points by means of a teaching method, which operating points are then no longer overshot by the mobile working machine with a working arm. It is furthermore possible to sense constant changes in position and to store by means of a teaching method in such a way that subsequent control does not become necessary.

In all these method variants it is, however, important that the measurement of the respective reference position and of the actual position is carried out by means of the inclination sensors in a position of rest of the mobile working machine and of the working arm.

BRIEF DESCRIPTION OF THE DRAWINGS

The disclosure will now be described in more detail with reference to the appended figures, of which.

DETAILED DESCRIPTION

Figure 1:
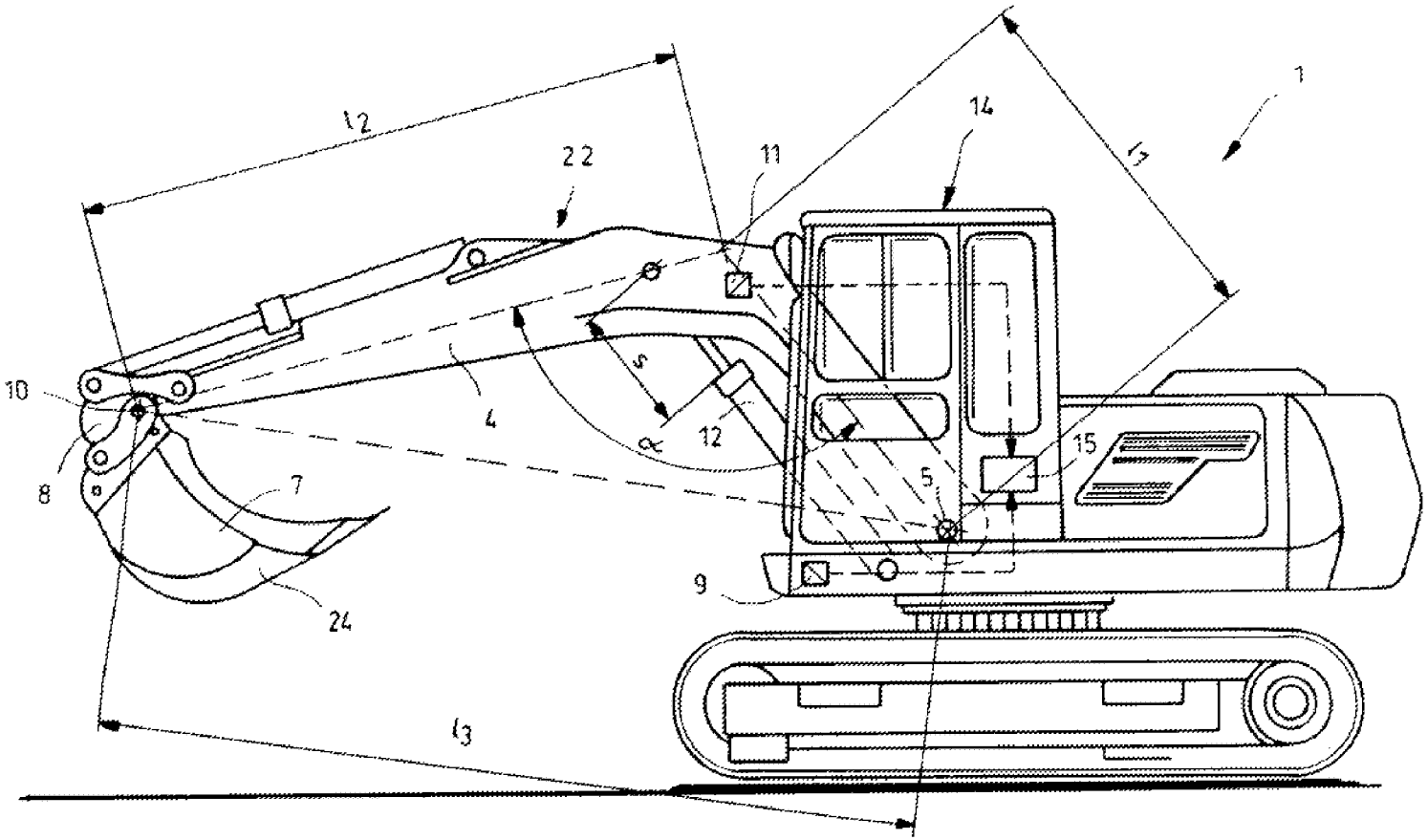
FIG. 1 shows a schematic illustration of a mobile working machine of a first embodiment of the disclosure.

FIG. 1 shows a schematic illustration of a mobile working machine 1 according to a first embodiment of the disclosure. This working machine 1 is an excavator 11, which has a superstructure 6 on a chassis 13, wherein the superstructure 6 can be pivoted with respect to the chassis 13 about a horizontal rotational angle. An implement 22 with a working arm 4 is arranged on the superstructure 6, which working arm 4 is attached in an articulated fashion by a first end 5 to the superstructure 6 and has, at a second end 8 which can be considered at the same time as being an operating point 10, a tool 7 which is an excavator shovel 24 in this embodiment.

The working arm 4 is bent at a fixed angle a, with the result that an effective working arm length $l_3$ is obtained from the lengths $l_2$ and $l_2$ of the limbs of the working arm 4 which are bent at the angle a with respect to one another. In order to be able to precisely determine a precise measurement for, for example, the operating point 10 at the start of a change in position, the superstructure 6 has a first inclination sensor 9, and the working arm 4 has a second inclination sensor 11. A reference position of the operating point 10 in the stationary state of the mobile working machine 1 can be determined precisely from the geometry of the working arm 4 and by using the angles of inclination of the inclination sensors 9 and 11.

After a change in position of the operating point 10, an actual value of the operating point 10 can in turn be determined in the stationary state of the working machine 1. During the change in position, the latter can be determined by a cylinder travel s by taking into account a volume flow of hydraulic fluid into the hydraulic cylinder 12 or out of the hydraulic cylinder 12 for the time period of the change. This actual position can, on the one hand, be determined again precisely by the inclination sensors 9 and 11 when the mobile working machine 1 is in a stationary state, and the difference with respect to a setpoint value can occur iteratively by repeatedly changing the position and determining the actual position after the change in position.

The evaluation of the measurement signals of the inclination sensors 9 and 11 are fed to a control unit 12 which simultaneously evaluates the volume flows into the hydraulic cylinder 12 and from the hydraulic cylinder 12 and calculates therefrom the cylinder travel s or the displacement travel of the piston in order to continuously record the change in position during the entire change in position, on the basis of an operating point which is measured at the start. After a change in position of the operating point 10, the actual position of this operating point 10 can be checked and determined precisely by the inclination sensors 9 and 11 in the stationary state. Determining the control deviation permits the error between the actual value and the setpoint value to be reduced iteratively.

Figure 2:
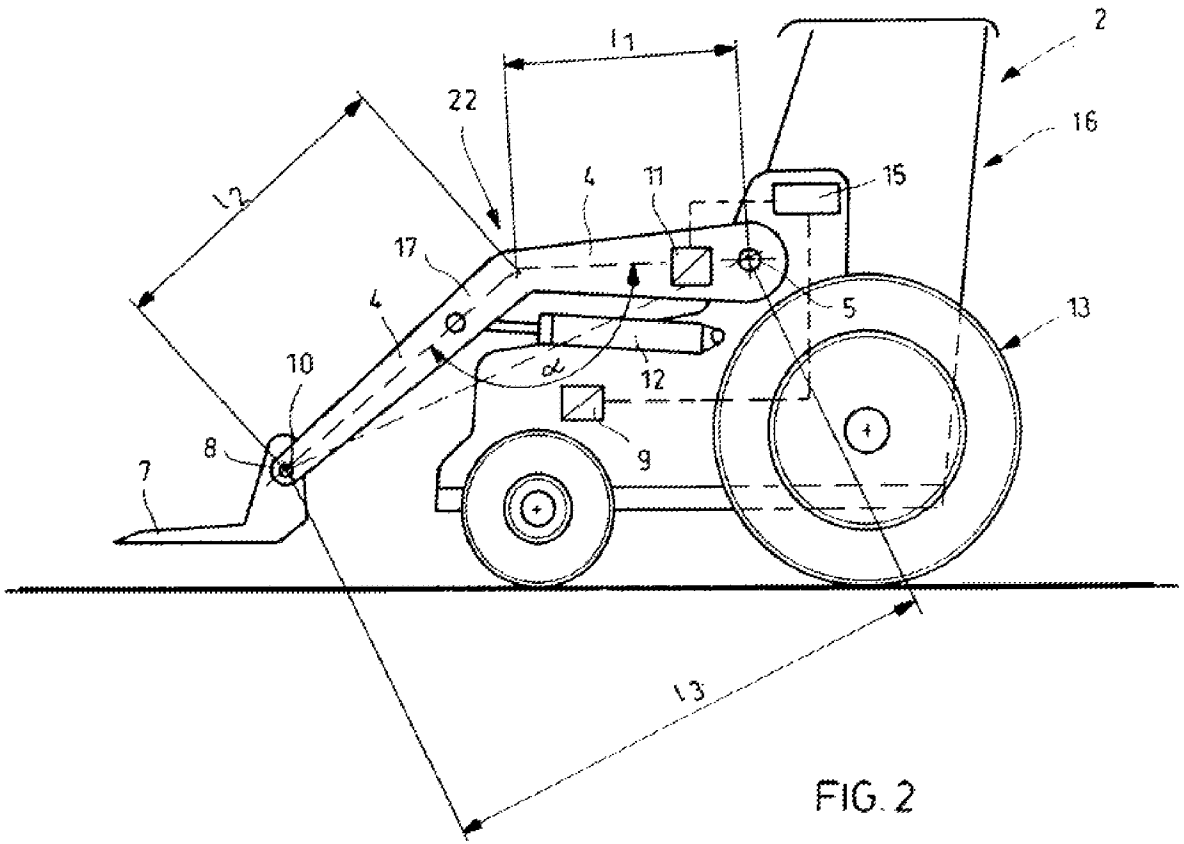
FIG. 2 shows a schematic illustration of a mobile working machine of a second embodiment of the disclosure.

FIG. 2 shows a schematic illustration of a mobile working machine 2 according to a second embodiment of the disclosure. This working machine 2 is a tractor 16 with a front loader 17 which has a bent working arm 4, wherein in turn the limbs of the working arm 4 are at a fixed angle a with respect to one another, and an effective length $l_3$ can be calculated from the lengths $l_1$ and $l_2$ of the bent limbs of the working arm. Components with identical functions, as in FIG. 1, are characterized with the same reference symbols and not mentioned separately. In contrast to FIG. 1, a superstructure is arranged here on the chassis 13 which cannot be rotated with respect to the chassis 13 but rather only with the chassis 13.

Figure 3:
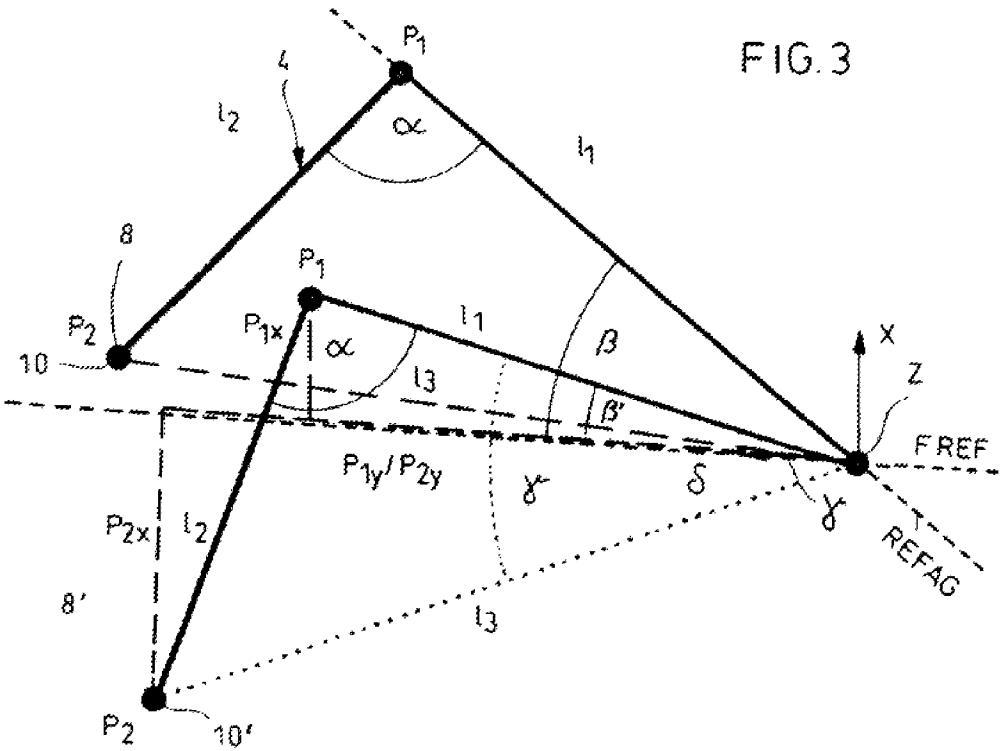
FIG. 3 shows a schematic diagram relating to a change in position of an operating point of a mobile working machine with a bent working arm.

FIG. 3 shows a schematic diagram of a change in position of a bent working arm 4 with the limb lengths $l_1$ and $l_2$, which are bent at an angle a with respect to one another, wherein in the event of a change in position the bending point $P_1$ migrates to the bending point $P_1'$, and the operating point 8 in the form of the endpoint $P_2$ of the working arm 4 migrates to the changed operating point 8' or $P_2'$. In the process, the angle of inclination β, which is given as a reference angle, changes to the angle of inclination β' after the change in position, wherein β and β' are arranged over the abscissa of a Cartesian coordinate system with x and y axes. The angle of inclination β denotes the difference between the vehicle reference FREF and the reference of the implement REFAG. While the angle of inclination β changes to the angle of inclination β', the bending point $P_1$ can migrate into the bending point $P_1'$, wherein the bending point $P_1'$ has an abscissa of $P_{1x}=\sin\beta'\cdot l_1$ and a coordinate length of $P_{1y}=\cos\beta'\cdot l_1$.

The change in position of the second point $P_2$, which can at the same time be an operating point 10, moves to the point $P_2$ with the abscissa $P_{2x}=\sin d\cdot l_3$ and with the coordinate $P_{2y}=\cos d\cdot l_3$, wherein the length $l_3$ is obtained from $l_3=l_1^2+l_2^2-2\cdot l_1\cdot l_2\cdot\cos a$. The angle d is obtained from the relationship $d=\gamma-\beta'$, wherein $\gamma=\beta$ if the working arm 4 is a rigid bent one and a does not change. However, if the working arm 4 is composed of two segments which can correspond to the bent limbs of the working arm 4, further angles and length relationships then occur which are not specified here in particular but which can be derived at any time from the geometric peripheral conditions. The angle β is here the difference between the vehicle reference, which may be in practice a working plane, and the reference of the implement with respect to a first limb of the bent working arm 4. FIG. 3 therefore makes it clear that the change in the operating point can be determined precisely both in a staring position and in an end position using the inclination sensors when the mobile working machine is in a stationary state.

Figure 4:
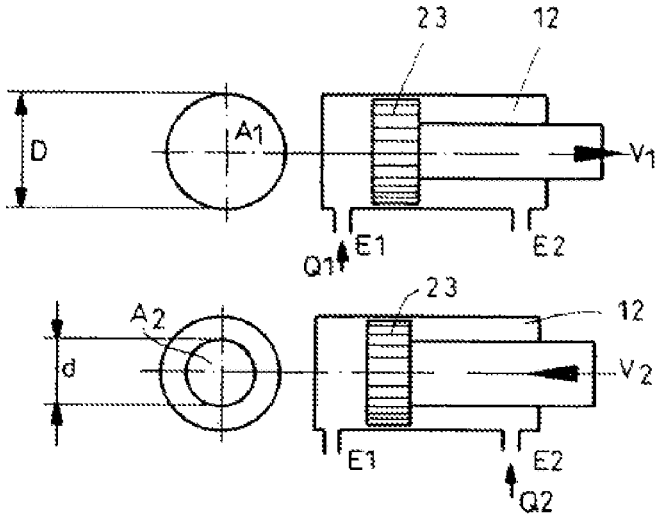
FIG. 4 shows schematic illustrations for calculating the cylinder travel by means of the volume flow to a hydraulic cylinder with an inlet before the cylinder piston and an inlet after the cylinder piston.

FIG. 4 shows schematic illustrations for the calculation of the cylinder travel s plotted against the volume flow Q to a hydraulic cylinder 12 with inlets $E_1$ and $E_2$ before and after the cylinder piston 23. If a volume flow $Q_1$ occurs in the hydraulic cylinder 12 via the opening $E_1$, the effective piston area $A_1$ is a circular area which corresponds to the internal diameter D of the cylinder 23, and is obtained from $A_1=D^2\cdot p/4$. There follows from this a piston speed $v_1=Q_1/A_1$ in, for example cm per second (cm/s). If a volume flow $Q_2$ is forced via the inlet $E_2$ into the cylinder 12, the piston speed $v_2=Q_2/A_2$ with the effective piston area $A_2=(D_2^2-d_2^2)\cdot p/4$, which corresponds to a circular ring.

Different piston speeds therefore occur at the same volume flow, depending on whether the volume flow is fed to the cylinder 12 via the inlet $E_1$ or via the inlet $E_2$. Since the piston speed v is the piston travel or cylinder travel s divided by t, i.e. $v=s/t$, and the volume speed $Q=v\cdot A$, and therefore $Q=s\cdot A/t$, with the volume flow Q in $cm^3/s$, the time difference t in s and the area A in $cm^2$, the cylinder travel, which corresponds to the piston travel as $s=Q\cdot t/A$, is obtained, it being possible to determine therefrom a characteristic curve diagram for the cylinder, from which diagram the cylinder travel or the displacement travel of the piston then results.

It is therefore possible to continuously track the change in the operating point during the change in position of the working arm and to output a first actual value for the changed position of the operating point, which actual value is then sensed as a secured actual value using the inclination sensors in the stationary state of the working machine, and the difference between the actual value and a setpoint operating point can then be fed back as a control variable in order to obtain iteratively the setpoint value of the operating point for implements of a mobile working machine.

Figure 5:
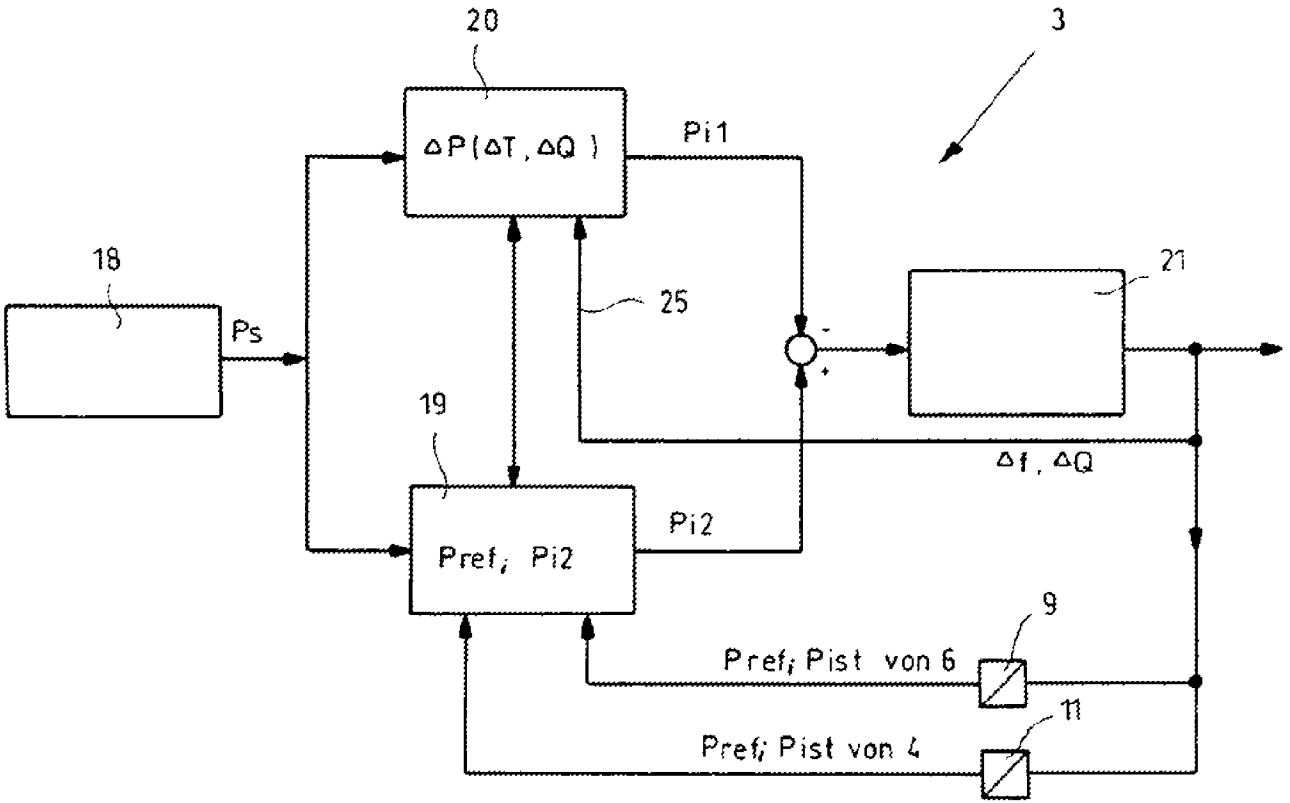
FIG. 5 shows a block circuit diagram of a control device for a change in position of an operating point of a working arm of a mobile working machine.

FIG. 5 shows a block diagram of a control device 3 relating to the change in position of an operating point of a working arm of a mobile working machine. A position setpoint value $P_s$, by which the operating point of the working arm of the mobile working machine is to be changed, is predefined from an operator control console 18. For this purpose, a reference position $P_{ref}$ is firstly determined using the position control block 19, into which the measured values of the inclination sensors 9 and 11 at a superstructure of the working machine and at the working arm are fed.

The change in position by ΔP from this reference value $P_{ref}$ is simultaneously sensed by means of the position change block 20 as a function of the time difference Δt and the volume flow Q, and a first position actual value or a first manipulated variable $P_{i1}$ is determined and is checked using the position control block 19 when the mobile working machine is in a stationary state and is defined as $P_{i2}$, with the result that with the control block 21 it is possible to compare the deviation of the checked position as an actual value $P_{i2}$ with the setpoint value $P_s$, and the position change block 20 can then be actuated again by means of a feedback branch 25 in order to reduce the difference between the setpoint value $P_s$ and the precise actual value $P_{i2}$.

LIST OF REFERENCE SYMBOLS

1 Mobile working machine (1st embodiment)
2 Mobile working machine (2nd embodiment)
3 Control device
4 Working arm
5 First end of the working arm
6 Superstructure
7 Tool
8 Second end of the working arm
9 First inclination sensor
10 Operating point
11 Second inclination sensor of the working arm
12 Hydraulic cylinder
13 Chassis

14 Excavator
15 Control unit
16 Tractor
17 Front loader
18 Operator control console
19 Position checking block
20 Position change block
21 Control block
22 Implement
23 Cylinder piston
24 Excavator shovel
25 Feedback branch
$A_1$ Effective piston area for $Q_1$
$A_2$ Effective piston area for $Q_2$
$P_1$ Actual position
$P_s$ Setpoint position
$P_1$ Reference operating point
$P_1'$ Second operating point
$\Delta P$ Difference in position or change in position
Q Volume flow
s Cylinder travel
$\Delta t$ Time difference
$\Delta Q$ Difference in volume flow

The invention claimed is:

1. A mobile working machine comprising:
a control device including a working arm which is arranged in an articulated fashion with a first end on a superstructure of the working machine;
a tool which is arranged at a second end of the working arm so as to be capable of moving about an operating point;
at least one first inclination sensor which is arranged on the superstructure;
at least one second inclination sensor which is arranged on the working arm;
at least one hydraulic cylinder which is arranged in an articulated fashion between the superstructure and the working arm in order to change the operating point; and
a control unit for processing the signals of the at least two inclination sensors for determining a first operating point as a reference operating point and for determining a change in position of the operating point by calculating a cylinder travel on the basis of a volume flow into or out of the hydraulic cylinder at a second operating point for a limited time interval.

2. The mobile working machine as claimed in claim 1, wherein the working arm has a number of segments which are connected to one another in an articulated fashion.

3. The mobile working machine as claimed in claim 1, wherein:
the superstructure is mounted so as to be rotatable with respect to a chassis, and
a means of sensing the rotational angle in order to determine the operating point is provided.

4. The mobile working machine as claimed in claim 1, wherein the inclination sensors have pendulum bodies, refractive liquid levels, micromechanical or conductor metric or capacitively acting structures.

5. The mobile working machine as claimed in claim 1, wherein the mobile working machine is embodied as an excavator, as a tractor with a front loader, as a telescopic loader, as a backhoe loader, as a wheel loader, as a forestry machine, as a communal working machine, as an agricultural machine or as a loading crane.

6. A method for controlling the operating point of a working arm of a mobile working machine comprising:
measuring angles of inclination of the superstructure and of a working arm which is arranged in an articulated fashion with a first end on the superstructure, by means of inclination sensors;
calculating a first reference position of the operating point at a second end, bearing a tool, of the working arm taking into account the measurement results of the measured angles of inclination;
changing a position of the operating point into a predefined setpoint position by means of a hydraulic volume flow during a limited time interval into or out of a hydraulic cylinder which is arranged in an articulated fashion between the superstructure and the working arm;
checking the changed working position while determining an actual position by the inclination sensors; and
reducing a difference between the setpoint position and the actual position.

7. The method as claimed in claim 6, wherein the effective piston area and the time period during the change in position of the operating point are taken into account for the calculation of the change in position of the operating point.

8. The method as claimed in claim 6, wherein:
at first a rotational angle between the superstructure and a chassis of the working machine is sensed, and
after a change in position of the working position a changed rotational angle is taken into account in the calculation of the amended working position.

9. The method as claimed in claim 6, wherein:
the working arm is composed of a plurality of segments which are connected to one another in an articulated fashion, and
an inclination sensor is arranged on each segment, and the volume flow of at least one associated further hydraulic cylinder is taken into account in the change in the operating point.

10. The method as claimed in claim 6, wherein error deviations for changed working positions are stored in the computing unit and are taken into account in the method step c).

11. The method as claimed in claim 6, wherein safety positions for operating points are sensed and stored by means of a teaching method for critical operating points.

12. The method as claimed in claim 6, wherein constant changes in position are sensed and stored by means of a teaching method.

13. The method as claimed in claim 6, wherein the measurement of the actual position is carried out by means of the inclination sensors in a position of rest of the mobile working machine and of the working arm.

* * * * *